United States Patent [19]

Igashira et al.

[11] Patent Number: 4,667,638

[45] Date of Patent: May 26, 1987

[54] FUEL INJECTION APPARATUS FOR INTERNAL COMBUSTION ENGINE

[75] Inventors: Toshihiko Igashira, Toyokawa; Yasuyuki Sakakibara, Nishio; Yasuhiro Takeuchi; Seiko Abe, both of Okazaki; Hidetaka Nohira, Mishima, all of Japan

[73] Assignees: Nippon Soken, Inc., Nishio; Toyota Jidosha Kabushiki Kaisha, Toyota, both of Japan

[21] Appl. No.: 723,897

[22] Filed: Apr. 16, 1985

[30] Foreign Application Priority Data

Apr. 17, 1984 [JP] Japan ..... 59-75797
Jan. 22, 1985 [JP] Japan ..... 60-8316
Mar. 16, 1985 [JP] Japan ..... 60-051582

[51] Int. Cl.[4] ..... F02M 47/02; F02M 59/42

[52] U.S. Cl. ..... 123/446; 123/179 G; 123/187.5 R

[58] Field of Search ..... 123/187.5 R, 446, 179 G, 123/447, 458, 460, 299, 300; 417/118, 119, 120

[56] References Cited

U.S. PATENT DOCUMENTS

| | | | |
|---|---|---|---|
| 2,175,743 | 10/1939 | Coffman | 123/187.5 R |
| 2,821,183 | 1/1958 | Roosa | 123/187.5 R |
| 3,308,794 | 3/1967 | Bailey | 123/446 |
| 3,888,223 | 6/1975 | Mondt | 123/187.5 R |
| 4,388,908 | 6/1983 | Babitzka | 123/446 |
| 4,462,346 | 7/1984 | Haman et al. | 123/187.5 R |

*Primary Examiner*—Willis R. Wolfe, Jr.
*Attorney, Agent, or Firm*—Cushman, Darby & Cushman

[57] ABSTRACT

A fuel injection apparatus including a fuel injector, a high pressure feed pump, and an auxiliary pump. The high pressure feed pump supplies highly pressurized fuel to the fuel injector while the engine is driven. The auxiliary pump supplies highly pressurized fuel at least on starting of the engine. The auxiliary pump is driven independent of the engine while the high pressure feed pump is driven by the engine.

18 Claims, 13 Drawing Figures

FUEL INJECTION APPARATUS FOR INTERNAL COMBUSTION ENGINE

BACKGROUND OF THE INVENTION

1. Field of the Invention

The present invention relates to a fuel injection apparatus for an internal combustion engine, more particularly to an improvement of a fuel injection apparatus to make the engine start quickly.

2. Description of the Related Art

For controlling the quantity of fuel discharged from a fuel injector with high precision so as to most efficiently run an engine, it is advantageous to use electrical control means to open and close the fuel injector. Electrical control means are already extensively used in gasoline engines, but are only beginning to be used for diesel engines.

In a diesel engine, the fuel pressure is relatively high. It takes a considerable amount of time to pressurize the entire fuel supply system, including the reservoir and accumulator, when starting the engine. Therefore, the engine cannot start quickly in spite of electrical control. Also, the highly pressurized fuel may leak out of the engine after the engine is stopped.

SUMMARY OF THE INVENTION

Accordingly, the present invention has as its object to provide a fuel injection apparatus which quickly supplies highly pressurized fuel to the engine to allow the engine to start quickly.

The present invention has an another object to provide a fuel injection apparatus from which fuel will not leak after the engine is stopped.

According to the present invention, there is provided a fuel injection apparatus including: a fuel injector, a high pressure feed pump, an auxiliary pump, means for driving the high pressure feed pump, and means for controlling the auxiliary pump. The high pressure feed pump is connected to the fuel injector and supplies high pressure fuel to the fuel injector during engine operation. The auxiliary pump is connected to the fuel injector and supplies high pressure fuel to the fuel injector at least during engine start-up.

Preferably, the auxiliary pump reduces the pressure of fuel in the fuel injector on stopping of the engine.

BRIEF DESCRIPTION OF THE DRAWINGS

The present invention will be better understood from the ensuing description, made, by way of example, of the embodiments of a fuel injection apparatus according to the present invention, with reference to the accompanying drawings, wherein.

DESCRIPTION OF THE PREFERRED EMBODIMENTS

The present invention is now described with reference to the embodiments shown in the attached drawings.

Figure 1:
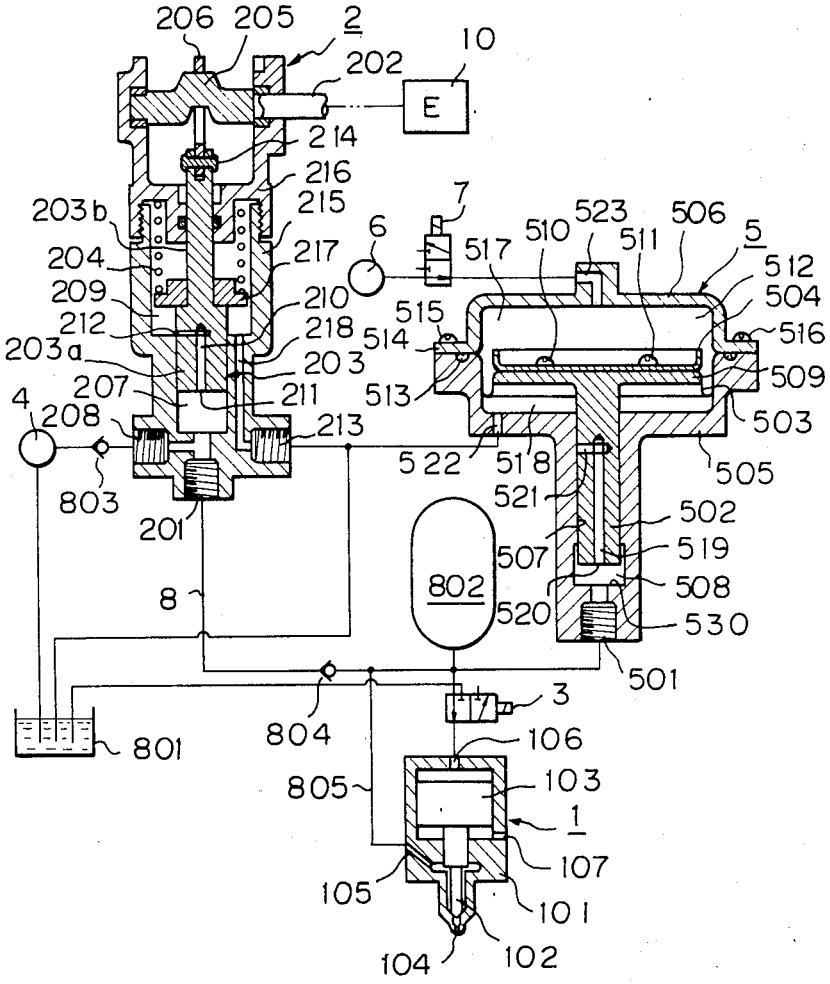
FIG. 1 is a sectional view of a first embodiment of the present invention.

Referring to FIG. 1, the fuel injection apparatus of a first embodiment includes a fuel injector 1, a high pressure feed pump 2, an auxiliary pump 5 for starting an engine, a low pressure feed pump 4, an air pump 6, two control valves 3 and 7, and a fuel piping system 8 including a fuel tank 801, a reservoir 802, and check valves 803 and 804.

The fuel injector 1 is mounted in an internal combustion engine, for example, a diesel engine, and injects fuel (gas oil) into a combustion chamber thereof. The fuel injector 1 is composed of a nozzle body 101, a nozzle needle 102, and a control piston 103, the nozzle needle 102 and the control piston 103 being slidably fitted in the nozzle body 101, respectively. The nozzle body 101 is formed with openings such as an injecting opening 104 for injecting fuel into the combustion chamber, a feed port 105 for taking in fuel to be injected, a control port 106 for introducing fuel which presses the piston 103, and a drain port 107. The nozzle needle 102 is disposed in the nozzle body 101 in such a manner that it moves up and down along the axis thereof, allows fuel to pass from the feed port 105 to the injecting opening 104 at a needle rising position, and shuts the feed port 105 and the injecting opening 104 at a needle descending position. The control piston 103 is acted on by a control pressure (i.e., fuel pressure) through the control port 106 and is movable up and down coaxially with the nozzle needle 102 to apply force to the nozzle needle 102 cause it to rise and descend.

The feed port 105 communicates with the reservoir 802 through high pressure piping 805. The control port 106 is controlled to be switched in such a manner that it selectively communicates with the reservoir 802 or the fuel tank 801 by the control valve 3. The reservoir 802 is connected to discharge port 201 of the high pressure feed pump 2 through the check valve 804 to keep the fuel pressurized to 200 kg/cm$^2$. When the control port 106 and the reservoir 802 are in communication with each other by action of the control valve 3, the nozzle needle 102 shuts the injecting opening 104 by the force acting on the control piston 103. Conversely, when the control port 106 and the fuel tank 801 are in communication with each other by the switching of the control valve 3, the downward force of the control piston 103 is released, so that the nozzle needle 102 moves upward by action of 200 kg/cm$^2$ fuel pressure acting upward on the nozzle needle 102 through the feed port 105. The injecting port 104 and the feed port 105 are thus in communication with each other, so that fuel in the reservoir 802 is injected through the injecting port 104.

The control valve 3 is an electrically-controlled three-way valve. It receives commands from a computer (not shown) to allow communication between the control port 106 and the fuel tank 801 only during fuel injection. The timing of the fuel injection is about the top-dead-center of compression of the internal combustion engine, and the period of fuel injection is between 0.5 msec and 2 msec. In the case of a four-stroke-cycle engine, one fuel injection is carried out during two rotations of a crankshaft. Now, in the case of an engine having four cylinders, one fuel injector 1 is provided for each cylinder, that is, four fuel injectors are provided in all, so fuel injection is carried out at about the top-dead-center of compression of each cylinder. In this case, four control valves 3 are necessary, each valve 3 forming a respective pair with a fuel injector 1. However, only one reservoir 802 need be provided irrespective of the number of the cylinders. Now, the reservoir 802 need not be provided if the volume of the high pressure piping 805 connected to the feed port 105 and the control port 106 is sufficiently large.

The high pressure feed pump 2 carries out a pumping action by rotation of a camshaft 202. For this pumping action, the high pressure feed pump 2 slidably supports a plunger 203 in a casing 215 and a cap 216 threadingly is fit to the casing 215. The plunger 203 is composed of a large diameter portion 203*a* and a small diameter portion 203*b* and is always biased downward by a spring 204 provided between an annular member 217 fit around the small diameter portion 203*b* and a lower surface of the cap 216. A pump chamber 207 is defined between the lower surface of the plunger 203 and the casing 215, the volume of the pump chamber 207 being changed by ascent and descent of the plunger 203. This pump chamber 207 is connected to the low pressure feed pump 4 through an inlet port 208 and is connected to the reservoir 802 and the fuel injector 1 through a discharge port 201.

The camshaft 202 is journaled by the cap 216 and is constructed in such a manner that it is driven in synchronization with the internal combustion engine 10, so that a suction stroke is carried out halfway between every two injections of the fuel injector 1, without distinction of the fuel injector. The suction stroke is carried out by the action of the camshaft 202 pulling up the plunger 203 against the spring 204. The discharge stroke is carried out by the action of the bias force of the spring 204 on the plunger 203 as a result of the release by the plunger 203 of the camshaft 202.

These actions are carried out by the rotation of a crank-shaped cam 205 in a ring-shaped hanger 206 and engagement with the inner surface of the hanger 206. The hanger 206 is connected to the plunger 203 by a pin 214. The pump chamber 207 is always in communication with the discharge port 201 and the inlet port 208, the inlet port 208 communicating with an outlet of the low pressure feed pump 4 through the check valve 803. The low pressure feed pump 4 is an electrically driven vane type pump, pressurizes fuel in the fuel tank to 5 kg/cm$^2$ for supply to the high pressure feed pump 2, which pressurizes the fuel in the pump chamber 207 to 200 kg/cm$^2$ by a biasing force of the spring 204 on the discharge stroke for supplying the fuel to the reservoir 802. Note that the low pressure feed pump 4 should be provided with a 5 kg/cm$^2$ relief valve, in the pump or out of the pump, for improvement of durability. This construction is not described herein since it is well known.

In the high pressure feed pump 2, a passage 210 is formed in the large diameter portion 203*a* of the plunger 203, for communicating pump chamber 207 and a spring chamber 209 formed under the annular member 217. This passage 210 has an opening 211 communicating with the pump chamber 207 at all times and an opening 212 communicating with the spring chamber 209 only when the plunger 203 rises to the top position. These passage and openings are provided for removing air bubbles in the pump chamber 207. The spring chamber 209 communicates with the fuel tank 801 through a passage 218 and a drain port 213 formed in the casing 215.

The reservoir 802 is supplied with high pressure fuel from the high pressure feed pump 2 through the check valve 804 and is in communication with an outlet port 501 of the auxiliary pump 501, so that high pressure fuel is supplied to the reservoir 802 from the auxiliary pump 5 only once on starting of the engine, as described below.

The auxiliary pump 5 is comprised of a plunger 502, a diaphragm 503, a retainer 504, a lower casing 505, and an upper casing 506. The plunger 502 can slide in a cylindrical bore 507 formed in the lower casing 505, so that a pump chamber 508 carries out a pumping action by ascent and descent of the plunger 502. The upper portion of the plunger 509 is formed with a T-shape flange 509. The diaphragm 503 is held between the flange 509 and the dish-shaped retainer 504, whereby the diaphragm 503 and the plunger 502 are connected with each other. The flange 509 of the plunger 502 and the retainer 504 are connected by screws 510 and 511.

The lower casing 505 and the upper casing 506 are connected with each other by screws 515 and 516 at flange portions 513 and 514 thereof, respectively, so that inner chamber 512 is formed by the lower casing 505 and the upper casing 506. The outer periphery of the diaphragm 503 is held between both the flanges 513 and 514, so that the inner chamber 512 is divided into a high pressure chamber 517 and a low pressure chamber 518.

The plunger 502 is formed with a passage 519. This passage 519 is provided for connecting the pump chamber 508 and the low pressure chamber 518 and has an opening 520 in communication with the pump chamber 508 at all times, and an opening 521 in communication with the low pressure chamber 518 only when the plunger 502 is positioned at the highest position. The passage 519 is used to remove air bubbles from the pump chamber 508. The low pressure chamber 518 communicates with the fuel tank 801 through a drain port 522.

The upper casing, 506 is formed with a control port 523 in communication with the high pressure chamber 517, the control port 523 being controlled by the control valve 7 to selectively be in communication with the air pump 6 or the atmosphere. That is, the control valve 7 is an electrical three-way valve which vents the control port to the atmosphere when the engine stops, and couples the control port 523 to the outlet port of the air pump 6 a few seconds after receiving a signal indicating the turning on of a keyswitch when the engine starts.

The air pump 6 is an electrically controlled vane type pump, the discharge pressure being 5 kg/cm$^2$.

The effective diameter of the diaphragm 503 and the diameter of the plunger 502 are determined in such a manner that the fuel in the pump chamber 508 balances at 200 kg/cm$^2$ when air pressure of 5 kg/cm$^2$ is introduced into the high pressure chamber 517.

Note that the stroke volume of the pump chamber 508 must be at least 2% of the internal volume of all the high pressure piping 805, including the reservoir 802 and the pump chamber 508.

This embodiment described above operates as follows.

When the keyswitch (not shown) is turned on to start the engine 10, electrical power is supplied to the motors of the low pressure feed pump 4 and the air pump 6 so that these pumps start to operate. At this time, the control valves 3 and 7 are not energized yet, so that the control valve 3 connects the reservoir 802 to the control port 106 while the control valve 7 vents the control port 523 to the atmosphere. Fuel discharged from the low pressure feed pump 4 flows to the pump chamber 207 of the high pressure feed pump 2 through the check valve 803 and reaches the reservoir 802 via the outlet port 201 and the check valve 804. This fuel acts in such a manner that it pushes up the needle 102 of the fuel injector 1 to open the injecting opening 104, but since the force by which the control valve 103 pushes down the needle 102 is larger than the fuel pressure force, the needle 102 keeps closed the injecting opening 104 so that the fuel injector 1 will not inject fuel. Low pressure fuel reserved in the high pressure piping 805 including the reservoir 802 fills in the pump chamber 508 of the auxiliary pump 5 to push up the plunger 502. Thus, the plunger 502 exposes the opening 521 in the low pressure chamber 518, so that the fuel supplied from the low pressure feed pump 4 flows out from the openings 521 into the low pressure chamber 518 to return to the fuel tank through the drain port 522. As a result, air bubbles contained in the high pressure piping 805 and the pump chamber 508 are expelled.

About 2 seconds are required for the above described cycle.

The control valve 7 is provided with a timer (not shown). By the action of the timer, electric current starts to flow between 2 and 3 seconds after the keyswitch is turned on. As a result, the control valve 7 is changed so that highly pressurized air is supplied from the air pump 6 to the high pressure chamber 517. The plunger 502 is pressed downward by this air pressure (5 kg/cm$^2$) so that the fuel in the pump chamber 508 is pressurized. If the stroke volume of the pump is sufficiently large, the plunger 502 stops the descending movement when the fuel pressure in the pump chamber 508 reaches 200 kg/cm$^2$. However, if the volume of the pump chamber 508 is set at the lowest required level (2% of all the volume of high pressure piping 805, including the reservoir 802 and the pump chamber 508), the plunger 502 comes close an may the lowest portion to contact the lower step portion 530 of the lower casing 505 to stop. High pressure fuels perhaps lower in pressure than 200 kg/cm$^2$, is thus accumulated in the reservoir 802.

About 3 seconds are required for the above cycle after the keyswitch is turned on.

Thus, by carrying out a cranking motion by the starter (not shown), the engine starts. After starting of the engine, the plunger 502 of the auxiliary pump 5 keeps engaged with or becomes positioned close to the bottom of the pump chamber 508. When pressure over 200 kg/cm$^2$ is generated in the high pressure piping 805, however, the plunger 502 moves slightly upward and can act as an accumulator. The high pressure feed pump 2 supplies fuel to the reservoir 802.

The camshaft 202 is driven in synchronization with the internal combustion engine 10, to pull up the plunger 203 and release it every bottom dead center of the expansion stroke. The released plunger 203 moves downward by action of the spring 204 to compress the pump chamber 207 to carry out a discharge stroke. The force of the spring 204 balances with the fuel pressure in the pump chamber 207 when the fuel pressure in the pump chamber 207 reaches 200 kg/cm$^2$, so that the plunger 203 stops. After that, when the internal combustion engine 10 comes near to top dead center of the compression stroke, the computer (not shown) acts to supply a current pulse to the control valve 3, so that the control port 106 communicates with the fuel tank 801, and the needle 102 moves upward because of the fuel pressure introduced through the feed port 105 so that the injecting port 104 is opened to inject fuel. While fuel in the reservoir 802 is consumed by the fuel injection, the plunger 203 of the high pressure feed pump 2 moves downward corresponding to the consumption volume to carry out the discharge stroke. The above operation is carried out periodically in synchronization with the internal combustion engine 10.

When the keyswitch is turned off to stop the internal combustion engine 10, the motors of the low pressure feed pump 4 and the air pump 4 are cut off from electric power and stop. The control valve 3 is also cut off, so that the control port 106 of the fuel injector 1 is in communication with the reservoir 802, and fuel injection stops irrespective of the condition of the engine. Similarly, the control valve 7 is cut off from electric power and opens the control port 523 to the atmosphere. At the same time, the plunger 502 is pushed up by the inner pressure in the reservoir 802, so that the inner pressure is reduced. The inner pressure is reduced to almost the atmospheric pressure. The reason the inner pressure is not reduced exactly to the atmospheric pressure is the gravity force of the plunger 502, the diaphragm 503, the retainer 504, and so on. This remaining low pressure keeps the fuel injector 1 closed, and prevents the fuel from leaking from the fuel injector 1. Incidentally, a weak spring may be provided for biasing the needle 102 of the fuel injector 1 downward.

While the high pressure feed pump 2 and the auxiliary pump 5 can both effect pressurization to 200 kg/cm$^2$ in this first embodiment, the high pressure feed pump 2 may be given a greater pressurization capacity than the auxiliary pump 5. By this construction, the pump chamber 508 of the auxiliary pump 5 can function as an accumulator. In this case, as the opening 521 of the plunger communicates with the low pressure chamber 518 to relieve the pressure in the pump chamber 508 when the pressure is over 200 kg/cm$^2$, the auxiliary pump 5 functions as a pressure regulator.

If the air pump 6 is constructed to have a variable discharge pressure in the first embodiment, the injection pressure of the fuel injector 1 can be changed. In this case, the opening 521 of the plunger functions as a pressure regulator.

Further, for driving the auxiliary pump 5, the low pressure feed pump 4 may be used instead of the air pump 6. In this case, the auxiliary pump 5 cannot function as an accumulator.

Figure 2:
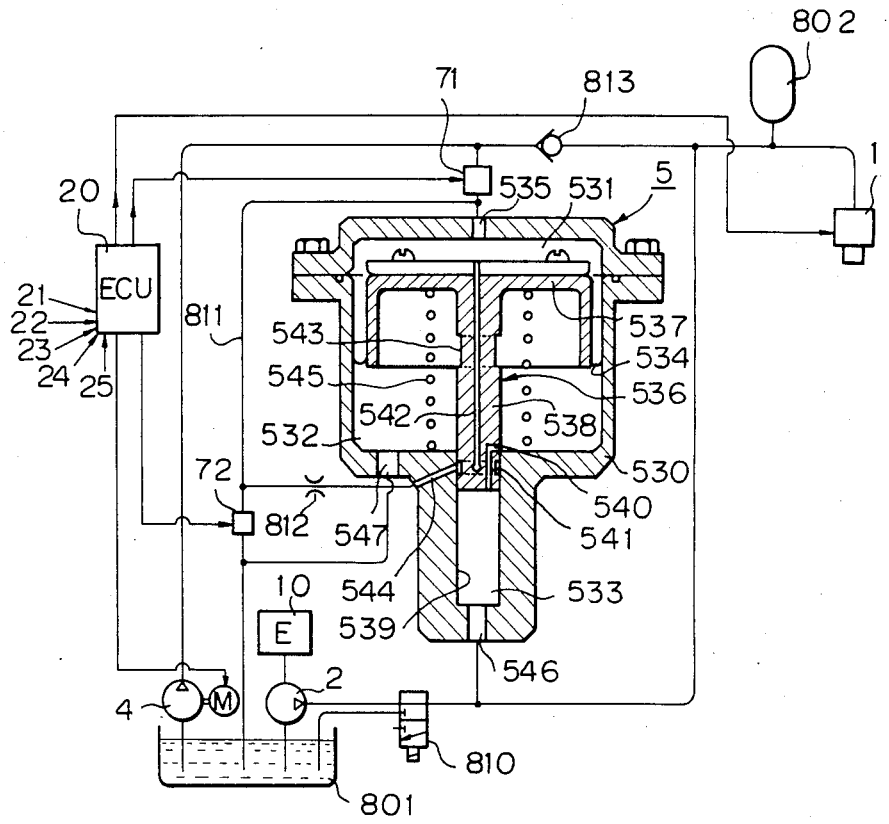
FIG. 2 is a sectional view of an auxiliary pump of a second embodiment.

A second embodiment of the present invention is shown in FIGS. 2 through 5. Referring to FIG. 2, a low pressure feed pump 4 is electrically controlled to pressurize fuel reserved in a fuel tank 801 to relatively low pressure. The pressure by which the fuel is fed is kept to 5 kg/cm$^2$ by a regulator (not shown). A high pressure feed pump 2 driven by an engine 10 pressurizes the fuel in the fuel tank 801 to a high pressure. Its pressurizing capacity is 200 kg/cm$^2$ or more. A high pressure regulator 810 keeps the high feed pressure generated by the pump 2 to a constant value of 200 kg/cm$^2$ or more pressure. Reference numeral 1 indicates a fuel injector, and 802 indicates a reservoir whose volume is 100 cc and which receives the high feed pressure supplied from the high pressure feed pump 2.

Figure 5:
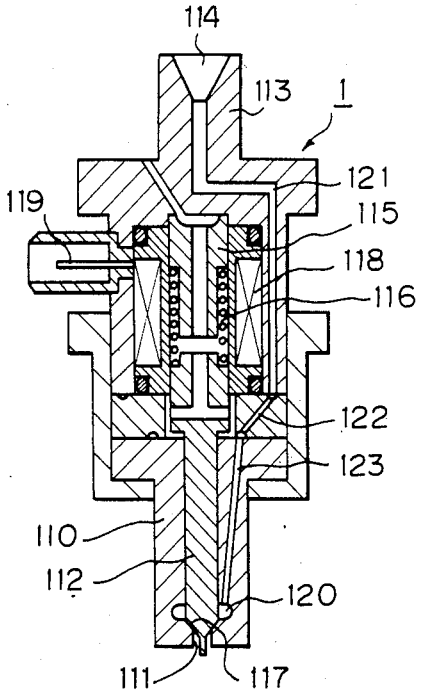
FIG. 5 is a sectional view of a fuel injector of the second embodiment.

FIG. 5 shows a construction of the fuel injector 1. The fuel injector 1 has a nozzle body 110 formed with an injecting opening 111, a nozzle needle 112 being slidably housed in the nozzle body 110. In a nozzle holder 113 having an inlet port 114 for fuel, a core 115 is fixed in such a manner as to face the upper end of the nozzle needle 112, a spring 116 being provided between the core 115 and the nozzle needle 112 for pressing the nozzle needle 112 to a seat face 117 formed near the injecting opening 111 to close the fuel injector 1. Around the core 115 is provided a solenoid coil 118 connected to a terminal 119.

If an electric current is sent to the solenoid coil 18 through the terminal 119, a magnetic force is generated in the solenoid coil 118, so that the nozzle needle 112 is pulled to the core 115 against the spring 116 and is separated from the seat face 117. Since the inlet port 114 of the nozzle holder 113 is in communication a fuel reservoir 120 formed near the seat face 117 through fuel passages 121, 122, and 123, fuel is injected from the injecting opening 111 when the nozzle needle 112 separates from the seat face 117. If the electric current to the solenoid coil 118 is cut off, the nozzle needle 112 is again pressed to the seat face 117 by a force of the spring 118, so that the fuel injection ends.

Opening and closing of the fuel injector 1 about each cylinder of the engine is carried out by an electronic control unit (ECU) 20. The ECU 20 receives a crank angle signal 21, a piston top dead center (TDC) signal 22, a cylinder discrimination signal 23, an accelerator opening degree signal 24, a signal 25 from the keyswitch, and so on. The ECU 20 adjusts a quantity of fuel injection and a timing of fuel injection about each cylinder of the engine according to these signals and sends output signals to the terminal 119 of each fuel injector 1.

An auxiliary pump 5 (see FIG. 2) supplies highly pressurized fuel to the fuel injector 1 when the engine is started. The auxiliary pump 5 has a casing 530 divided into a high pressure chamber 531, low pressure chamber 532, and pump chamber 533. The high pressure chamber 531 and the low pressure chamber 532 are separated from each other by a diaphragm 534. The high pressure chamber 531 has an inlet port 535 for introducing fuel into the chamber 531, the inlet port 535 being connected to the low pressure feed pump 4 through a solenoid valve 71. A piston 536 having a flange 537 and a small diameter portion 538 is provided in the casing 530, the flange 537 being connected to the diaphragm 534. Now, the diameter of the small diameter portion 536 is 8 mm, while the diameter of the flange 537 is 50 mm.

Figure 3:
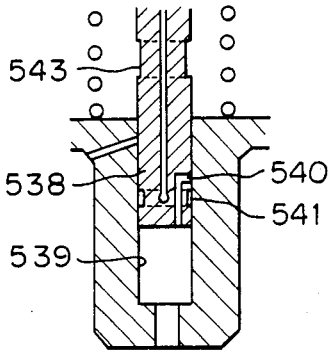
FIG. 3 is a sectional view of a main part of the auxiliary pump of FIG. 2 in an initial state of fuel pressing stroke.
Figure 4:
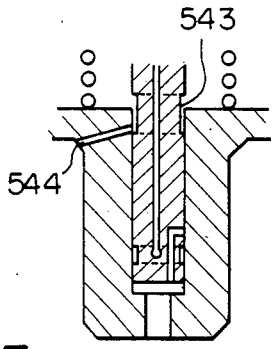
FIG. 4 is a sectional view of the main part of FIG. 3 in a state in which the main part is in the lowest position.

The small diameter portion 536 is slidably inserted in a cylinder bore 539 formed in the lower portion of the casing 530, so that the pump chamber 533 is defined by the end face of the small diameter portion 536 and the cylinder bore 539 and is separated from the low pressure chamber 532. The small diameter portion 538 is formed with a drain passage 540, which connects the pump chamber 533 and the low pressure chamber 532 when the piston 536 moves up to come close to near the maximum stroke position as shown in FIG. 3. An annular groove 541 is formed on an outer periphery of the lower portion of the small diameter portion 538, and a passage 542 is formed in the piston 536 along the axis thereof, so that the annular groove 541 and the high pressure chamber 531 are in communication with each other. Further, an annular relief groove 543 is formed on the outer periphery of the upper portion of the small diameter portion 538. When the piston 536 moves down to near the maximum stroke position as shown in FIG. 4, the relief groove 543 communicates with a relief port 544 formed in the casing 530, so that the low pressure chamber 532 is in communication with the high pressure chamber 531 through a tube 811 connecting the relief port 544 and the inlet port 535 of the high pressure chamber 531. The tube 811 is formed with an orifice 812. A spring 545 is provided in the low pressure chamber 532 for urging the piston 536 upward. An outlet port 546 of the pump chamber 533 is in communication with an outlet port of the high pressure feed pump 2.

The outlet passage of the low pressure feed pump 4 branches in two directions, one of which is connected to the high pressure chamber 531 through a solenoid valve 71, and the other of which is connected to the outlet port of the high pressure feed pump 2 through a check valve 813. Now, the check valve 813 is constructed in such a manner that it passes the fuel only from the low pressure feed pump 4 downstream. The high pressure chamber 531 is connected to the fuel tank 801 through a solenoid valve 72, while the low pressure chamber 532 is connected to the fuel tank 801 through an outlet port 547.

Operations of the low pressure feed pump 4, the solenoid valve 71, and the solenoid valve 72 are controlled by the ECU 20 similar to the fuel injector 1.

The embodiment constructed as described above operates as follows.

On starting of the engine, by turning the keyswitch on, the ECU 20 drives the low pressure feed pump 4, opens the solenoid valve 72, and closes the solenoid valve 71. The fuel discharged from the low pressure feed pump 4 flows into the pump chamber 533 through the check valve 813 to push up the piston 536. When the piston 536 moves up and reaches near the maximum stroke, the drain passage 540 communicates with the low pressure chamber 532 so that air bubbles within the pump chamber 533 are discharged into the low pressure chamber 532.

Then, the solenoid valve 72 is closed and the solenoid valve 71 is opened. The high pressure chamber 531 receives 5 kg/cm$^2$ pressure from the low pressure feed pump 4 to press the flange 537 downward. Now, since the diameter of the flange 537 is 50 mm and the diameter of the small diameter portion 538 is 8 mm, in this embodiment, the sectional area ratio of the flange 537 and the portion 538 is 39:1. Therefore, the pressure within the pump chamber 533 rises to 39 times the pressure of the high pressure chamber 531, that is, the pressure within the pump chamber 533 becomes 195 kg/cm$^2$.

Under this condition, the check valve 813 keeps closed. In order that the piston 536 pressurizes the fuel piping including the 100 cc reservoir 802 to 195 kg/cm$^2$, the small diameter portion 538 should be 40 mm in length, assuming that fuel is reduced by 1% under 100 atmospheric pressures. In order to obtain more than 200 kg/cm$^2$ pressure, the small diameter portion 538 needs to be longer.

By the above described operation, the fuel injector 1 receives pressure over 100 kg/cm$^2$, which is sufficient for starting the engine.

After the engine starts, fuel is supplied to the fuel injector 1 by the high pressure feed pump 2 driven by the engine 10. Since the set pressure of the regulator 810 is 200 kg/cm$^2$ and the high pressure feed pump 2 has a pressurizing capacity of 200 kg/cm$^2$ or more, 200 kg/cm$^2$ pressure acts on the fuel injector 1 after starting of the engine. The solenoid valves 71 and 72 are closed at the time when the engine starts combustion by itself.

FIG. 3 shows the small diameter portion 538 of the piston 536 immediately after the engine starts. In this condition, while the drain passage 540, the annular groove 541, and the annular relief groove 543 are not in communication with any port, the highly pressurized fuel in the pump chamber 532 gradually leaks and flows between the outer surface of the small diameter portion 538 and the cylinder bore 539. This leaking fuel is led to the high pressure chamber 531 through the annular relief passage 540 and the passage 542. The fuel within the high pressure chamber 531 cannot flow anywhere, so that the piston 536 moves downward. Thus, the piston 536 descends near the maximum stroke as shown in FIG. 4. As a result, the annular relief passage 543 communicates with the relief port 544 formed in the casing 530, so that the fuel within the high pressure chamber 531 flows through the inlet port 535, the tube 811, the orifice 812, and the relief port 544 to flow into the low pressure chamber 532.

In this case, if the relief groove 543 and the relief port 544 are not provided, the diaphragm 534 is broken after the piston moves down and reaches the maximum stroke, because the leaking fuel from the pump chamber 533 flows into the high pressure chamber 531 so that the high pressure chamber 531 becomes extremely high in pressure. The pressure in the high pressure chamber 531 may become the same pressure as the pump chamber 533 in the case where the pressure of the high pressure chamber 531 is at a maximum.

However, in this embodiment, the piston 536 is stopped from moving down at the position shown in FIG. 4 by action of the annular relief groove 543 and the relief port 544, so that the pressure is stable.

After the engine stops, if the solenoid valve 72 is opened, the fuel in the high pressure chamber 531 returns to the fuel tank 801, so that the pressure in the high pressure chamber 531 is released. The piston 536 then moves upward by the force of the spring 545 to reduce the pressure of the highly pressurized fuel. By this action, fuel leakage after stopping of the engine is prevented.

Figure 6:
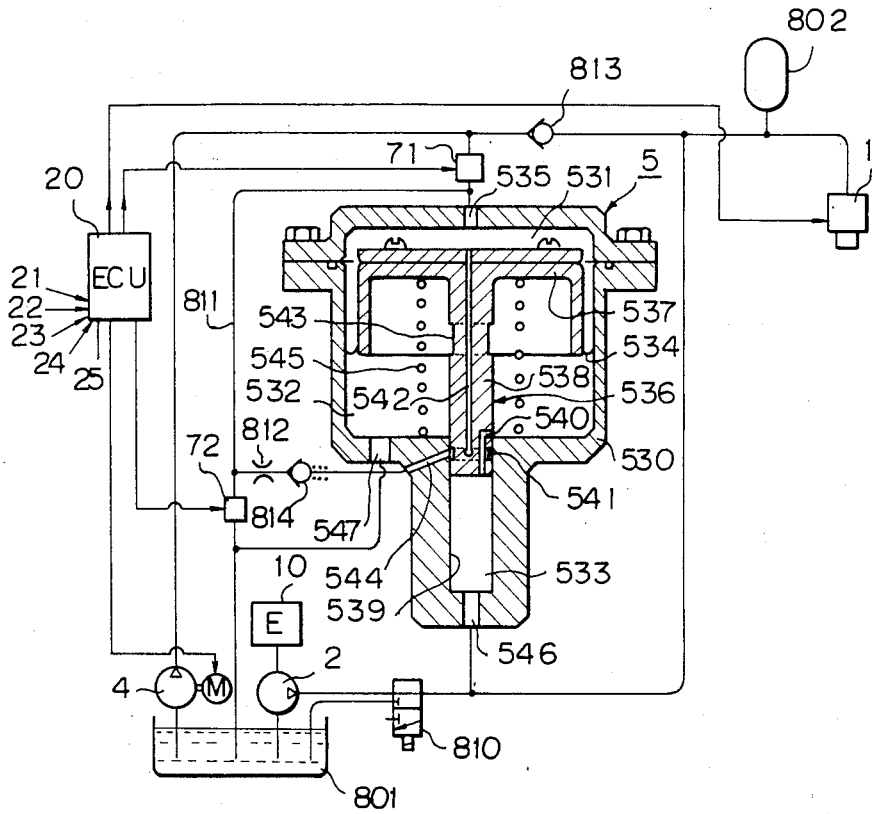
FIG. 6 is a sectional view of an auxiliary pump of a third embodiment.

FIG. 6 shows a third embodiment of the present invention. The difference of this embodiment from the second embodiment is that a check valve 814 is provided in the tube 811, connecting the relief port 544 and the inlet port 535 of the high pressure chamber 531, in series with the orifice 812.

The pressure for opening the check valve 814 is set to 5 kg/cm$^2$, which is slightly higher than the feed pressure of the low pressure feed pump 4.

After the engine starts, when the piston 536 moves downward to reach the maximum stroke, as shown in FIG. 4, the relief groove 543, the relief port 544, and the low pressure chamber 532 are in communication with each other. However, as the check valve 814 is provided, the fuel within the high pressure chamber 531 will not flow into the low pressure chamber 532 immediately. Soon, the fuel which has leaked through the annular groove 540 and the passage 542 enters the high pressure chamber 531, so that the pressure in the high pressure chamber 531 reaches 7 kg/cm$^2$, which is the opening valve pressure of the check valve, whereby the check valve 814 opens and the high pressure chamber 531 is kept to 7 kg/cm$^2$. In this condition, the piston 536 descends to the maximum stroke, so that the lowest portion of the flange 537 engages the casing 530 and is held by the casing 530.

In this embodiment, the fuel in the high pressure chamber 531 will not flow into the low pressure chamber 532 all at once, therefore, vibration of the piston 536 and a pressure chamber is prevented. Then, the orifice 812 may be omitted.

Figure 7:
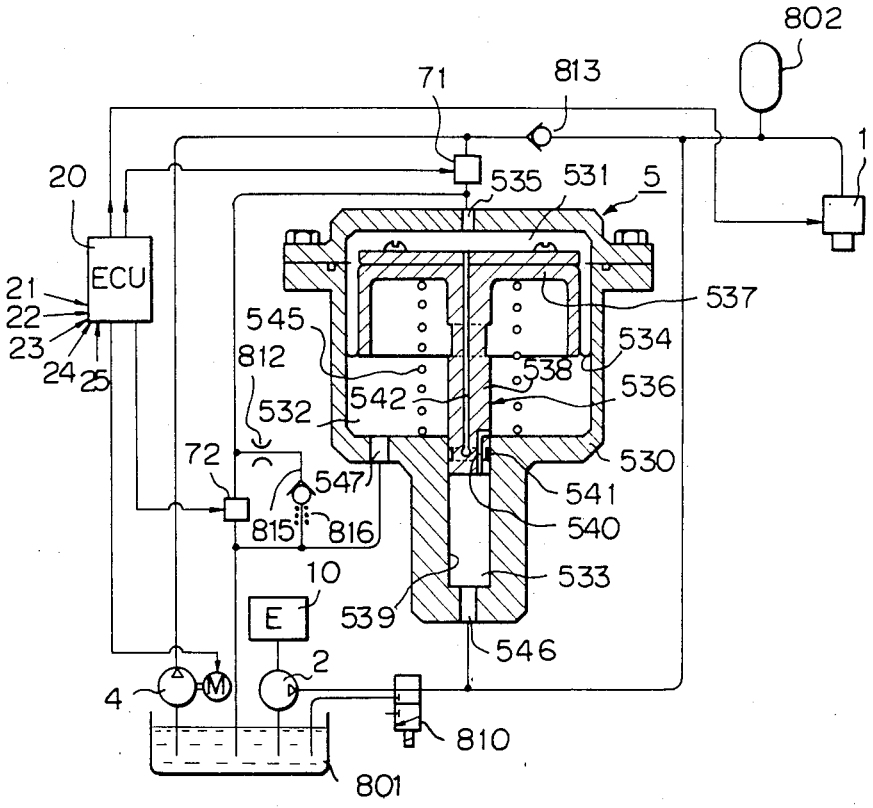
FIG. 7 is a sectional view of an auxiliary pump of a fourth embodiment.

FIG. 7 shows a fourth embodiment of the present invention. In this embodiment, while the relief groove 543 and the relief port 544 which are provided in the above second embodiment are eliminated, a tube 815 is provided for connecting the high pressure chamber 531 and the fuel tank 801, and a check valve 816 is deployed in the tube 815. The opening pressure of the check valve 816 is 7 kg/cm$^2$, similar to the case of the third embodiment.

In this embodiment, after the engine starts, the piston 536 moves downward to the maximum stroke and will not move further, so that the pressure in the high pressure chamber 531 rises. Thus, when this pressure becomes 7 kg/cm$^2$, the check valve 816 opens to relieve the pressure in the high pressure chamber 531 to the low pressure chamber 532. The orifice 812 may be eliminated in the embodiment.

Now, in the third and fourth embodiments, the check valves 814 and 816 may, of course, be relief valves.

Figure 8:
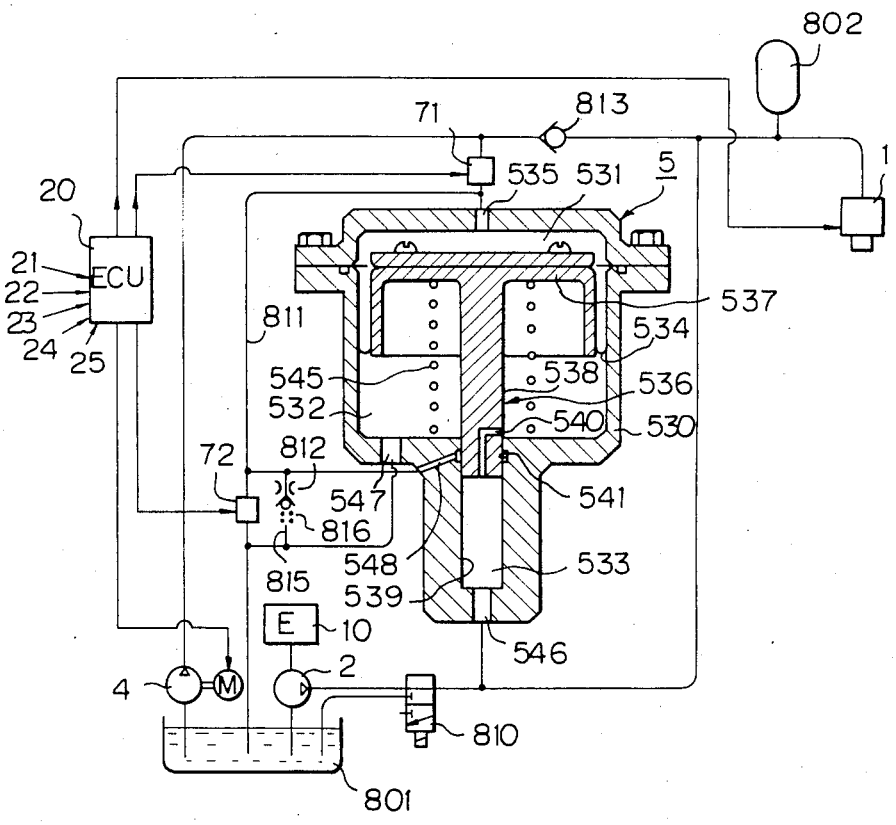
FIG. 8 is a sectional view of an auxiliary pump of a fifth embodiment.

FIG. 8 shows a fifth embodiment of the present invention. This embodiment is different from the fourth embodiment in that the annular groove 541 is not formed on the piston 536, but formed on the inner wall of the cylinder bore 539, and a passage 548 is formed in the casing 530 instead of formed in the piston 536, so that the leaking fuel is introduced to the high pressure chamber 531 through the annular groove 541, the passage 548, the tube 811, and the inlet port 535. The operation of this embodiment is almost the same as the fourth embodiment.

Figure 9:
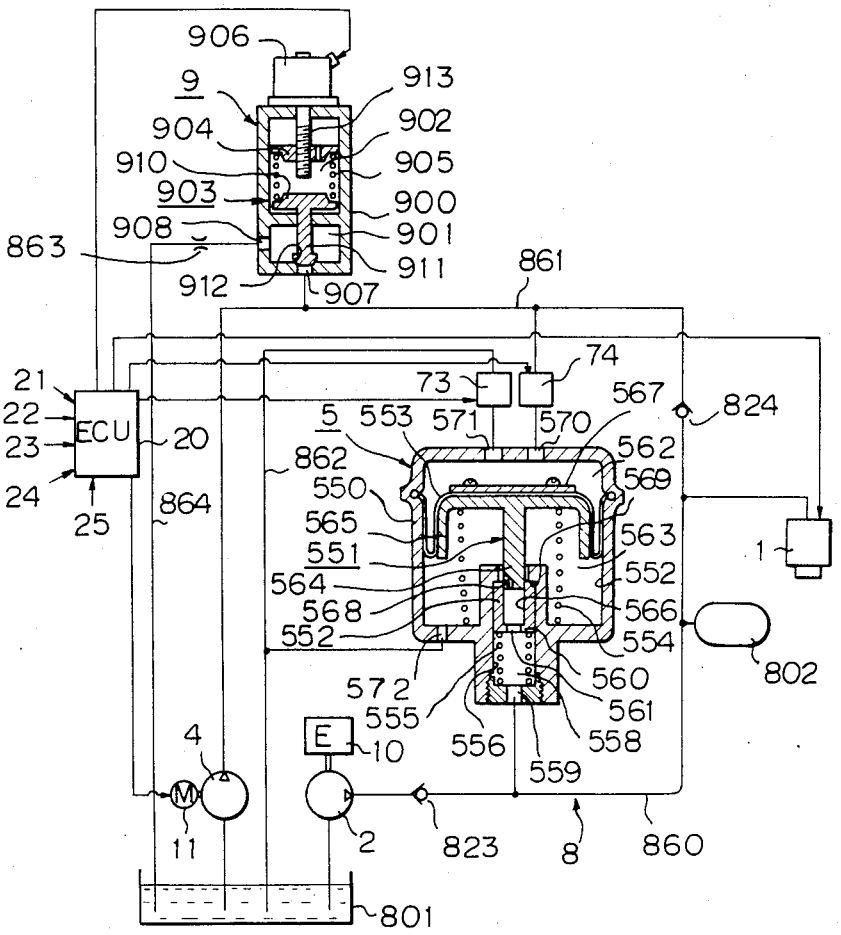
FIG. 9 is a sectional view of a sixth embodiment of the present invention.
Figure 10:
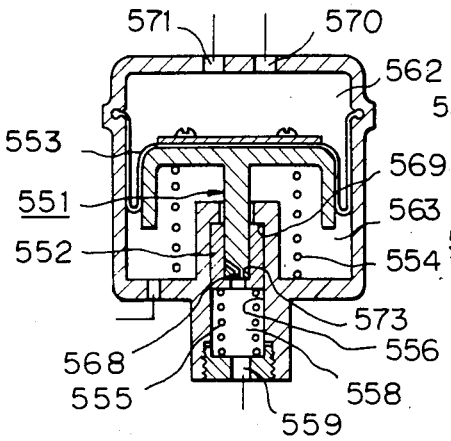
FIG. 10 is a sectional view of an auxiliary pump of the sixth embodiment in a state in which a piston is lowered relative to a spool.
Figure 11:
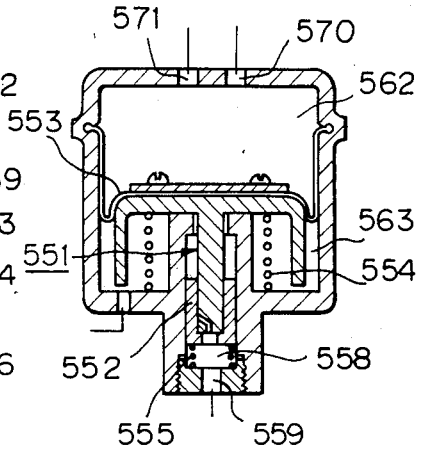
FIG. 11 is a sectional view of the auxiliary pump of the sixth embodiment in a state in which the piston is lowered with the spool.

FIGS. 9 through 11 show a sixth embodiment of the present invention.

A fuel injection apparatus of this embodiment includes a fuel injector 1, a high pressure feed pump 2, a low pressure feed pump 4, an auxiliary pump 5, a regulator 9, and two control valves 73 and 74, these elements being connected by a fuel piping 8 having a fuel tank 801, a reservoir 802, and check valves 823 and 824.

The fuel injector 1 has a well known construction, and opens in response to a signal sent from outside to inject and supply fuel into a combustion chamber of a diesel engine.

The high pressure feed pump 2 is driven by the engine 10 in such a manner to pressurize fuel in the fuel tank 801 and send the fuel to the fuel injector 1, reservoir 802, and the auxiliary pump 5. The low pressure feed pump 4 is driven by an electric motor 11 to pressurize fuel in the fuel tank 801 and supply the fuel to the regulator, which pressurizes the fuel to between 1 $kg/cm^2$ and 5 $kg/cm^2$.

The auxiliary pump 5 has a casing 550, a piston 551, a spool 552, a diaphragm 553, and springs 554 and 555. The casing 550 has a cylinder bore 556 having a small diameter and an internal chamber 557 having a large diameter. The spool 552 is cylindrical in shape and is slidably displaced in the cylinder bore 556 to define a pump chamber 558 in the cylinder bore 556. The pump chamber 558 communicates with a passage 860 through a hole 559, the passage connecting the high pressure feed pump 2, the reservoir 802, and fuel injector 1. An opening 561 is formed in an end wall 560 which is positioned at the side of the pump chamber 558 of the spool 552, so that the pump chamber 558 is in communication with the inside of the spool 552. The spring 555 is disposed between the end wall 560 of the spool 555 and a bottom surface of the pump chamber 558 to bias the spool 552 in such a manner that the pump chamber 558 is expanded. Now, the sectional area ratio of the diaphragm 553 to the small diameter portion 564 of the piston 551 is 150:1, while the sectional area ratio of the spool 552 to the small diameter portion 564 is 5:1.

The diaphragm 553 is disposed in the internal chamber 557 to divide the internal chamber 557 into a high pressure chamber 562 and a low pressure chamber 563. The piston 551 is composed of a rod-shaped small diameter portion 564 and a dish-shaped large diameter portion 565 connected to the small diameter portion 564, the small diameter portion 564 being slidably housed in a hole 566 formed in the axis portion of the spool 552, and the large diameter portion 565 being connected to the diaphragm 553 by a retainer 567. The small diameter portion 564 is formed with a connecting hole 568 which connects the end face of the small diameter portion 564 and a side surface of the small diameter portion 564. The connecting hole 568 is closed by an inner wall of the hole 566 when the small diameter portion 564 is positioned in a lower position relative to the spool 552 (as shown in FIGS. 2 and 3). Conversely, the connecting hole 568 connects the hole 566 of the spool 552 and the low pressure chamber 563 when the small diameter portion 564 is positioned in an upper position relative to the spool 552 while keeping the spool 552 in contact with an upper wall 569 of the cylinder bore 556.

A control port 570 and a drain port 571 are formed in an upper wall of the casing 550, while a drain port 572 is formed in a lower wall of the casing 550. The control port 570 connects the high pressure chamber 562 with the control valve 74, which communicates with a passage 861 connecting the low pressure feed pump 4, the regulator 9, and the fuel injector 1. The drain port 571 communicates the control port 570 with the control valve 73, which connects to the fuel tank 801 through the passage 862. The drain port 572 connects the low pressure chamber 563 to the passage 862.

The regulator 9 pressurizes fuel in the passage 862 to a constant pressure and has a casing 900 having a valve chamber 901 and an adjusting chamber 902, a valve 903 housed in the adjusting chamber 902 and the valve chamber 901, a retainer 904, a spring 905, and a pulse motor 906. An inlet port 907 and a drain port 908 are formed in a lower portion of the casing 900. The inlet port 907 is provided for connecting the valve chamber 901 to the passage 861, while the drain port 908 is provided for connecting the valve chamber 901 to the passage 864, which communicates with the fuel tank 801 through an orifice 863.

The valve 903 comprises a large diameter portion 910 disposed within the adjusting chamber 902 and a rod-shaped small diameter portion 911 which is connected to the large diameter portion 910 and is inserted in the valve chamber 901. The end portion of the small diameter portion 911 can tightly contact a seat face 912 formed inside the inlet port 907 in such a manner that it closes the inlet port 907. The valve 903 is always urged in a direction in which the valve 903 closes the inlet port 907, by the spring 905 provided between the large diameter portion 904 and the retainer 904. The retainer is threadingly fit to a screw portion formed on the output shaft 913 of the pulse motor 906, which is mounted on an outside wall of the casing 900 and projects the output shaft 913 into the adjusting chamber 902.

Thus, when the pressure in the inlet port 907 is low, the valve 903 is pressed by the spring 905 to the seat face 912 to close the inlet port 907. Conversely, when the pressure in the inlet port 907 exceeds a predetermined value, the valve 903 displaces against the spring 905 to open the inlet port 907. As a result, the fuel in the passage 861 is released into the passage 864 through the inlet port 907, the valve chamber 901, and the drain port 908 and returns to the fuel tank 801. Thus, the pressure in the inlet port 907 is lowered, so that the valve 903 is pressed by the spring 905 to tightly sit on the seat face 912 again to close the inlet port 907.

As understood from the above description, the force for opening the valve 903, i.e., valve-opening pressure, depends on the force of the spring 905. The retainer 904 is constructed in such a manner that it will not rotate about the output shaft 913 in the adjusting chamber 902. Therefore, when the output shaft 913 is rotated by the pulse motor 906, the retainer 904 moves back and forth to change the force of the spring 905, whereby the valve opening pressure is changed. Now, the valve opening pressure can be changed between 1 $kg/cm^2$ and 5 $kg/cm^2$.

An ECU 20 includes a microcomputer and receives from the engine 10 signals as described in the second embodiment to adjust the quantity of fuel injection and the timing of fuel injection for every cylinder according to the signals. Thus, the ECU 20 drives the pulse motor 906 of the regulator 9 and a motor 11 of the low pressure feed pump 4 and controls the control valves 73 and 74 and the fuel injector 1.

This sixth embodiment operates as follows. When the keyswitch (not shown) is turned on to start the engine 10, the ECU 20 drives the low pressure feed pump 4, closes the control valve 74, and opens the control valve 73. The ECU 20 drives the pulse motor 906 of the regulator 9 to set the set pressure of the regulator to the maximum value 5 $kg/cm^2$. Then the fuel discharged from the low pressure feed pump 4 flows through the passage 861, the check valve 824, and the passage 860 and flows into the pump chamber 558 through the hole 559, so that the piston 551 moves upward to return the fuel in the high pressure chamber 562 to the fuel tank 801 through the drain port 571, the control valve 73, and the passage 862. When the piston 551 moves to the highest position, the pump chamber 558 and the low pressure chamber 563 are connected to each other through the connecting hole 568, the hole 566, and the opening 561 of the spool 552. Therefore, the fuel flows from the pump chamber 558 to the low pressure chamber 563 and returns to the fuel tank 801 through the drain port 572 and the passage 862. During this operation, air bubbles in the piping including the fuel injector 1 are discharged to the fuel tank 801.

The ECU 20 then closes the control valve 73 and opens the control valve 74. As a result, fuel discharged from the low pressure feed pump 4 flows into the high pressure chamber 562 of the auxiliary pump 5 through the passage 861 and the control valve 74, so that the pressure in the high pressure chamber 562 is raised. Therefore, the piston 551 moves downward against the spring 554 while the fuel in the low pressure chamber 563 is discharged to the fuel tank 801 through the drain port 572. When the piston 551 begins to descend from the position shown in FIG. 9, the spool 552 is urged by the spring 555 to remain at rest. Therefore, the piston 551 moves downward relative to the spool 552, so that the connecting hole 568 is closed by the inner wall of the spool 552 and the lower end portion of the piston 551 engages a lower step portion 573 of the spool 552 (FIG. 10).

When the piston 551 displaces from the position of FIG. 9 to the position of FIG. 10, the check valve 824 is closed so that the pump chamber 558 is pressurized. The fuel injector 1 and the passage 860 thus become high pressure and the pressure in the reservoir 802 becomes 100 atmospheric pressures. Now, the volume of the reservoir 802 is 100 cc, while the volume in the spool 552 in the state of FIG. 9 is 1 cc.

As the pressure in the high pressure chamber 562 rises further, the piston 551 moves downward with the spool 552 against the spring 555 from the position of FIG. 10 (FIG. 11). Thus, the pressure in the pump chamber 558 is raised. When the force by which the piston 551 is pressed downward balances the pressure in the pump chamber 558 and the spring force of the spring 555, the piston 551 stops moving. By the way, as the set pressure of the regulator 9 is 5 kg/cm$^2$, as described above, the pressure in the high pressure chamber 562 is also 5 kg/cm$^2$. Therefore, if the force of the springs 554 and 555 are neglected, the pump chamber 558 is pressed according to the ratio of the sectional area of the diaphragm 553 and the sectional area of the spool, i.e., 30:1, so that the pressure in the pump chamber 558 reaches 150 kg/cm$^2$. That is, the fuel injector 1 is supplied with fuel at 150 kg/cm$^2$ pressure, so that the engine starts with ease.

Once the engine 10 starts, the high pressure feed pump 2 starts to operate, so that the fuel from the high pressure feed pump 2 flows into the pump chamber 558. Since the discharge pressure of the high pressure feed pump 2 is about 1000 kg/cm$^2$, the pressure in the pump chamber 558 of the auxiliary pump 5 is increased, so that the spool 552 is urged upward by the pressure in the pump chamber 558 to move upward with the piston 551. Thus, while the spool 552 contacts the upper wall 569 of the cylinder bore 556 as shown in FIG. 10, the piston 551 moves upward further since the piston 551 receives the pressure in the pump chamber 558 through the opening 561. The piston 551 stops at the position where the pressure in the pump chamber 558 balances the pressure in the high pressure chamber 562. In this state, the pressure ratio between the pump chamber 558 and the high pressure chamber 562 is equal to the sectional area ratio between the diaphragm 553 and the small diameter portion 564 of the piston 551, i.e. 150:1. That is, when the pressure in the high pressure chamber 562 is 5 kg/cm$^2$, the pressure in the pump chamber 558 is 750 kg/cm$^2$.

In this state, if the set pressure of the regulator 9 is changed by the pulse motor 906 between 1 kg/cm$^2$ and 5 kg/cm$^2$, the pressure in the pump chamber 558, i.e., the fuel supply pressure to the fuel injector 1, changes between 15 kg/cm$^2$ and 750 kg/cm$^2$. In other words, the fuel supply pressure can be lowered when the engine 10 is driven at low speed, while the fuel supply pressure can be raised when the engine 10 is driven at high speed. The fuel injection rate is therefore controlled to be low at low speed and high at high speed. Therefore, engine noise is restrained at low speed driving, while engine power is improved at high speed driving.

When the engine 10 is stopped, the ECU 20 opens the control valve 73. Thereupon, the fuel in the high pressure chamber 562 flows to the fuel tank 801 through the drain port 571 and the passage 862. As a result, the pressure in the high pressure chamber 562 is lowered, and the piston 551 is urged by the pressure in the pump chamber 558 to move upward to the highest position shown in FIG. 9. That is, the pump chamber 558 communicates with the low pressure chamber 563 through the connecting hole 518, so that the pressure in the fuel injector 1 and the passage 862 are lowered to become approximately equal to the pressure in the fuel tank 801.

According to the embodiment as described above, the engine starts smoothly and reliably, since the auxiliary pump 5 supplies the highly pressurized fuel to the fuel injector 1 prior to starting of the engine. On driving of the engine, the fuel pressure can be changed to restrain the engine noise and improve engine power, as the auxiliary pump 5 is constructed in such a manner that the output ability thereof is changed by the regulator 9 according to the driving condition of the engine.

Figure 12:
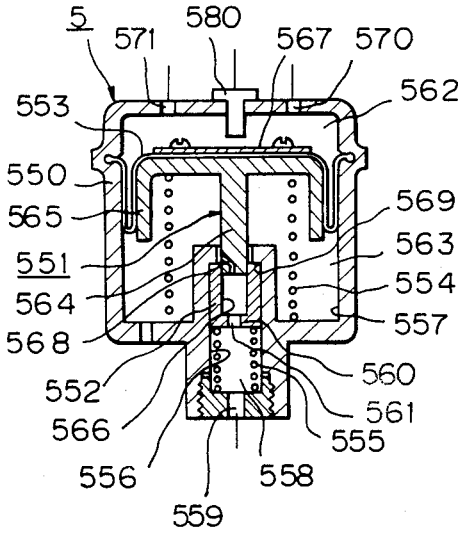
FIG. 12 is a sectional view of an auxiliary pump of a seventh embodiment.
Figure 13:
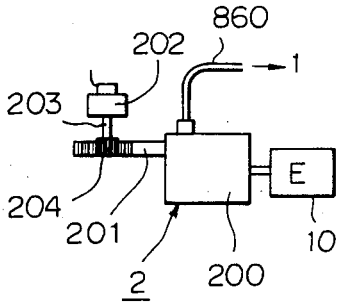
FIG. 13 is a plan view of a high pressure feed pump assembled in a fuel injection apparatus with the auxiliary pump shown in FIG. 12.

FIG. 12 shows an auxiliary pump 5 according to a seventh embodiment of the present invention. FIG. 13 shows a high pressure feed pump 2 assembled with the auxiliary pump 5. The auxiliary pump 5 is provided with a position sensor 580 on the casing 550, which senses a position of the piston 551, which is different from the auxiliary pump 5 of FIGS. 9 through 11. The output signal from the sensor 580 is sent to the ECU 20 (FIG. 9), which controls the discharge volume of the high pressure feed pump 2 according to the signal.

That is, the high pressure feed pump 2 is a variable capacity pump, the discharge capacity being adjusted by displacing a rack 201. The rack 201 is provided to a body 200 in such a manner that it moves back and forth. The rack 201 is connected to a cam-ring (not shown) having a discharge port of the variable capacity pump and threadingly engages with a pinion 204 fixed to an output shaft 203 of a pulse motor 202. The pulse motor 202 is driven by the ECU 20 so that the pinion 204 rotates to displace the rack 201, so that the discharge volume of the pump 2 is changed.

The auxiliary pump 5 controls, after starting of the engine, the fuel pressure supplied to the fuel injector 1 by action of the regulator 9, similar to the above sixth embodiment. If the discharge volume of the high pressure feed pump 2 is so large that the piston 551 moves upward above the predetermined position, the position sensor 580 senses the position of the piston 551 to send a signal to the ECU 20. Thereupon, the ECU 20 drives the pulse motor 202 to displace the rack 201, so that the discharge volume of the high pressure feed pump 2 is reduced. Conversely, if the fuel consumption of the fuel injector 1 is large, whereby the piston 551 moves downward under the predetermined position, the position sensor 580 senses the position of the piston 551 to send a signal to the ECU 20, so that the discharge volume of the pump 2 is increased. Thus, the discharge volume of the high pressure feed pump 2 can be adjusted in that condition.

Note that the low pressure feed pump 4 may be replaced by an air pump. In this case, the control valves 73 and 74 and the check valve 804 are unnecessary.

Although embodiments of the present invention have been described herein with reference to the attached drawings, many modifications and changes may be made by those skilled in the art without departing from the scope of the invention.

We claim:

1. A fuel injection apparatus for an internal combustion engine comprising:

a fuel injector;

a high pressure feed pump for supplying high pressure fuel to said fuel injector during driving of the engine, said high pressure feed pump having an outlet port;

an auxiliary pump for supplying injection pressure fuel to said fuel injector at least on starting the engine, said auxiliary pump having an outlet port;

electric actuator means for controlling the supply of high pressure fuel to said fuel injector, said actuator means being operable independent of said high pressure feed pump and said auxiliary pump; and means for driving said high pressure feed pump; and means for controlling said auxiliary pump.

2. A fuel injection apparatus according to claim 1, wherein said driving means includes the engine, while said controlling means acts independently of the engine.

3. A fuel injection apparatus for an internal combustion engine comprising:

a fuel injector;

a high pressure feed pump connected to said fuel injector for supplying high pressure fuel to said fuel injector during driving of the engine;

an auxiliary pump connected to said fuel injector for supplying high pressure fuel to said fuel injector at least on starting the engine, and for reducing pressure of fuel in said fuel injector on stopping the engine, means for driving said high pressure feed pump; and means for controlling said auxiliary pump.

4. A fuel injection apparatus according to claim 3, wherein said auxiliary pump comprises:

a casing having an internal chamber and a cylinder bore connected to said internal chamber;

a diaphragm provided in said internal chamber to define a high pressure chamber and a low pressure chamber in said internal chamber, said high pressure chamber being connected to said controlling means;

a cylindrical spool slidably fit in said cylinder bore to define a pump chamber in said cylinder bore, said pump chamber be connected to said high pressure feed pump and said fuel injector, said spool having an opening at an end portion facing said pump chamber;

a piston having a small diameter portion and a flange connected to said small diameter portion, said small diameter portion being slidably fit in said spool, said flange being situated in said internal chamber and connected to said diaphragm.

5. A fuel injection apparatus according to claim 4, wherein said piston is, prior to starting of the engine, urged by pressure in said high pressure chamber so that said small diameter portion is fully inserted into said spool to close said opening, so that said piston displaces with said spool to pressurize said pump chamber corresponding to the sectional area ratio of said diaphragm and said spool.

6. A fuel injection apparatus according to claim 4, wherein said piston is, during driving of the engine, urged by pressure in said high pressure chamber to displace independent of said spool to change the pressure in said pump chamber corresponding to the sectional area ratio of said diaphragm and said small diameter portion of said piston.

7. A fuel injection apparatus according to claim 4, wherein said small diameter portion of said piston is formed with a connecting passage extending from an end surface facing said spool to a side surface thereof, said connecting passage being closed by an internal wall of said spool when said piston comes close to said opening of said spool, said connecting passage communicating said pump chamber and said low pressure chamber when said piston separates from said opening by a predetermined value.

8. A fuel injection apparatus according to claim 4, wherein a position sensor for sensing the position of said piston is provided in said high pressure chamber.

9. A fuel injection apparatus according to claim 3, wherein said auxiliary pump comprises:

a casing having an internal chamber and a cylinder bore connected to said internal chamber;

a diaphragm provided in said internal chamber to define a high pressure chamber and a low pressure chamber in said internal chamber, said high pressure chamber being connected to said controlling means; and a piston having a small diameter portion and a flange portion, said small diameter portion being slidably fit in said cylinder bore to define a pump chamber in said cylinder bore, said flange portion being situated in said internal chamber and connected to said diaphragm, said pump chamber being in communication with said high pressure feed pump and said fuel injector.

10. A fuel injection apparatus according to claim 9, wherein said piston is urged by pressure in said high pressure chamber to move to pressurize said pump chamber to supply high pressure fuel to said fuel injector.

11. A fuel injection apparatus according to claim 10, wherein said high pressure chamber is highly pressurized by said controlling means when a keyswitch of the engine is turned on.

12. A fuel injection apparatus according to claim 10, wherein said high pressure chamber is highly pressurized by said controlling means after the lapse of a few seconds after a keyswitch of the engine is turned on.

13. A fuel injection apparatus according to claim 9, wherein said auxiliary pump is provided with a lead passage connecting an outer surface of said small diameter portion in said cylinder bore to said high pressure chamber, so that fuel leaking from said pump chamber to a gap between said small diameter portion and said cylinder bore flows into said high pressure chamber.

14. A fuel injection apparatus according to claim 13, wherein said lead passage comprised an annular groove formed on said outer surface of said small diameter portion and an internal passage formed in said piston along the axis thereof, said internal passage connecting said annular groove to said high pressure chamber.

15. A fuel injection apparatus according to claim 13, wherein said lead passage comprises an annular groove formed on an inner surface of said cylinder bore, a hole formed in said casing in such a manner that said annular groove is in communication with the outside of said casing, and a tube connecting said hole to an inlet port of said high pressure chamber.

16. A fuel injection apparatus according to claim 9, wherein said high pressure chamber and said low pressure chamber are connected through a communicating passage provided outside of said casing, said communicating passage connecting said high pressure chamber to said low pressure chamber when pressure in said high pressure chamber is over a constant value.

17. A fuel injection apparatus according to claim 16, wherein said communicating passage comprises a relief groove formed on said outer surface of said small diameter portion of said piston, a relief port formed in said casing in such a manner that the inside of said casing and outside of said casing are in communication with each other, and a tube connecting said relief port to an inlet port of said high pressure chamber.

18. A fuel injection apparatus according to claim 16, wherein said communicating passage comprises a tube connecting said high pressure chamber to said low pressure chamber, and a check valve provided in said tube and opening when pressure in said high pressure chamber is over a constant value.

* * * * *